US006157804A

United States Patent [19]

Richmond et al.

[11] Patent Number: 6,157,804

[45] Date of Patent: Dec. 5, 2000

[54] ACOUSTIC TRANSFER ASSIST DRIVER SYSTEM

[75] Inventors: David W. Richmond, Webster; Robert J. Mead, Hilton, both of N.Y.; Clifford K. Friend, Tehachapi, Calif.

[73] Assignee: Xerox Corporation, Stamford, Conn.

[21] Appl. No.: 09/532,575

[22] Filed: Mar. 22, 2000

[51] Int. Cl.[7] ..... G03G 15/14; G03G 21/00

[52] U.S. Cl. ..... 399/319; 310/311

[58] Field of Search ..... 399/319; 310/311, 310/316, 317

[56] References Cited

U.S. PATENT DOCUMENTS

| | | | |
|---|---|---|---|
| 4,987,456 | 1/1991 | Snelling et al. | 399/319 |
| 5,005,054 | 4/1991 | Stokes et al. | 355/273 |
| 5,016,055 | 5/1991 | Pietrowski et al. | 399/319 |
| 5,282,005 | 1/1994 | Nowak et al. | 355/273 |
| 5,329,341 | 7/1994 | Nowak et al. | 355/273 |
| 5,357,324 | 10/1994 | Monfort | 399/319 |
| 5,485,258 | 1/1996 | Monfort | 399/319 |
| 5,515,148 | 5/1996 | Monfort | 399/319 |
| 5,517,291 | 5/1996 | Monfort et al. | 399/319 |

*Primary Examiner*—Richard Moses

[57] ABSTRACT

A piezoelectric acoustic transducer, especially for a printer photoreceptor toner transfer assist system, having a mechanical resonance varying over a substantial frequency range, is driven by a driver circuit having an automatically variable frequency electrical power output. The driver circuit initially automatically slowly sweeps over a wide frequency range encompassing the resonance range of the transducer until the resonant frequency is detected from the electrical impedance change of the transducer at resonance. The driver circuit then automatically switches to a frequency control with a phase lock loop system responsive to the phase of the transducer voltage and current, to hold and maintain the driver circuit output at the varying resonant frequency of the transducer. A small frequency range rapid dithering of the driver circuit frequency may be additionally provided above and below the resonant frequency of the transducer.

16 Claims, 3 Drawing Sheets

ACOUSTIC TRANSFER ASSIST DRIVER SYSTEM

Disclosed in the embodiments herein is an improved system and circuitry for automatically providing appropriate variable frequency power to an electromechanical transducer with a variable resonant frequency. In particular, an improved acoustic transfer assistance (ATA) system for the transfer of toner imaging material from a photoreceptor surface in a xerographic printer.

Various types of acoustic transducers, drivers, and various specific applications thereof, are known in the art. In particular, it is known that acoustic transfer assist (ATA) systems may be used to impart vibrations to a printer photoreceptor or other surface which is bearing toner or other imaging material. Such known ATA systems provide improvements in the efficiency of the transfer of imaging material from one surface to another, such as from a developed latent image on a photoreceptor surface to the paper sheet on which the image is being printed.

The following Xerox Corp. U.S patent disclosures by David B. Montford are noted by way of some examples thereof: U.S. Pat. No. 5,515,148 issued May. 7, 1996 entitled "Resonator Assembly Including a Waveguide Member Having Inactive End Segments"; U.S. Pat. No. 5,512,991 issued Apr. 30, 1996 "Resonator Assembly Having an Angularly Segmented Waveguide Member"; U.S. Pat. No. 5,512,990 issued Apr. 30, 1996 "Resonating Assembly Having a Plurality of Discrete Resonator Elements"; U.S. Pat. No. 5,512,989, issued Apr. 30, 1996 "Resonator Coupling Cover for use in Electrostatographic Applications"; U.S. Pat. No. 5,357,324 issued Oct. 18, 1994 "Apparatus for applying Vibratory Motion to a Flexible Planar Member"; U.S. Pat. No. 5,329,341 issued Jul. 12, 1994 "Optimized Vibratory Systems in Electrophotographic Devices"; and U.S. Pat. No. 5,282,005 issued Jan. 25, 1994 "Cross Process Vibrational Mode Suppression in High Frequency Vibratory Energy Producing Devices for Electrophotographic . . . "; and Montford, et al U.S. Pat. No. 5,329,341 issued Jul. 12, 1994 "Optimized Vibratory Systems in Electrophotographic Devices"; and U.S. Pat. No. 5,282,005 issued Jan. 25, 1994 "Cross Process Vibrational Mode Suppression in High Frequency Vibratory Energy Producing Devices for Electrophotographic Imaging" (the latter two particular discussing resonant frequencies).

Also noted by way of further background on this subject are Xerox Corp. U.S. Pat. No. 5,081,500, issued Jan. 14, 1992 entitled "Method and Apparatus for using Vibratory Energy to reduce Transfer Deletions in Electrophotographic Imaging", by Snelling; and U.S. Pat. No. 5,005,054, "Frequency Sweeping Excitation of High Frequency Vibratory Energy Producing Devices for Electrophotographic Imaging", by Stokes, Nowak, Attardi and Costanza.

The latter U.S. Pat. No. 5,005,054 is of particular interest here, for its detailed descriptions of suitable details of an ATA system embodiment, particularly including 3 KHz frequency sweeping centered about the average natural frequency of all the segmented ATA horn segments, as described for example in Col. 11, especially at lines 23–26.

Also, that same U.S. Pat. No. 5,005,054 in the first full paragraph of Col. 5 cites, as an alternative application of that ATA system, a patent application Ser. No. 07/368,044, which is now Xerox Corp. U.S. Pat. No. 5,030,999 issued Jul. 9, 1991 (D/88396). This latter patent describes another application of the same type of high energy acoustic transducer system to vibrate a photoreceptor of a xerographic copier or printer. It similarly loosens toner from that imaging surface, but is for assisting in cleaning all of the toner from that surface after image transfer rather than for improving the image transfer efficiency of the toner. Thus, this can also be another application of the improved transducer driver circuit disclosed herein.

As will be clear to those skilled in this art, and from the above references, such an ATA or other systems for assisting in the release of toner from a photoreceptor, requires a driver power source which will provide the transducer with process requirements for meeting its application. The disclosed specially controlled driver power source provides a unique control and output power drive that enables the transducer system to be more successfully operated. Alternatively, it may be used for other such ultrasound acoustic vibratory transducer devices and systems, As will be further described below, the disclosed specific embodiment of a transducer driver circuit and its controls provides several advantageous features, individually or in combination, as compared to prior such systems. Wider latitude is provided for changes in the manufacture or assembly of the transducer that cause variations in the transducer load impedance and resonant frequency. Variations in the mean velocity of the transducer by temperature and load changes during operation can be reduced by tracking variations in the resonant frequency of the transducer using phase lock loop technology. Velocity non-uniformity due to segment-to-segment resonant frequency variations in a segmented transducer can be compensated for by frequency modulation applied to the multi-segment transducer. Yet, the disclosed transducer driver circuit with its automatic control systems may be implemented at relatively low cost and partially or fully in various commercially available, or other, discrete components and/or standard logic circuits or even single chip LSI designs.

A specific feature of the specific embodiment disclosed herein is to provide in a xerographic printing system with a photoreceptor which is bearing toner imaging material and an acoustic transducer system for appropriately acoustically vibrating said photoreceptor to assist in the removal of said toner imaging material from said photoreceptor, wherein said acoustic transducer system has an electromechanical transducer with a variable resonant frequency variable within a range of variable resonant frequencies, and wherein said acoustic transducer system has an electrical power driver circuit for driving said electromechanical transducer for said appropriately acoustically vibrating of said photoreceptor to assist in said removal of said toner imaging material from said photoreceptor, the improvement wherein: said electrical power driver circuit provides an automatically variable frequency electrical drive of said electromechanical transducer which includes; a wide band sweep generator for initially sweeping said variable frequency of said variable frequency electrical drive of said electrical power driver circuit over a wide frequency range encompassing said range of variable resonant frequencies of said electromechanical transducer, a resonant frequency detector for detecting when said frequency being swept by said sweep generator passes said resonant frequency of said electromechanical transducer, a switching circuit actuated by said resonant frequency detector; and a control loop circuit connected by said switching circuit to control said variable frequency electrical drive of said electrical power driver circuit to automatically track said variable resonant frequency of said electromechanical transducer.

Further specific features disclosed in the embodiment herein, individually or in combination, include those wherein said electromechanical transducer has electrical impedance changes corresponding to said variable resonant frequency of said electromechanical transducer, and wherein said resonant frequency detector and said control loop circuit are both responsive to said electrical impedance changes in said electromechanical transducer; and/or wherein said control loop circuit is a phase-lock loop circuit; and/or wherein said wide frequency range of said wide band sweep generator is several kilohertz; and/or wherein said electromechanical transducer is a plural element transducer with small variations in the resonant frequencies of said plural elements, and wherein said electrical power driver circuit further includes a chirp oscillator additionally varying said variable frequency over a much smaller frequency range than said wide frequency range of said wide band sweep generator or said control loop circuit when said switching circuit has connected said control loop circuit, so as to compensate for said small variations in said resonant frequencies of said plural elements of said electromechanical transducer; and/or wherein said sweep generator has a plural kilohertz sweep range and an approximately one second sweep cycle; and/or wherein said chirp oscillator has a sweep range of approximately zero to +600 hertz and an approximately 1 to 5 kilohertz sweep frequency; and/or a high-power, high frequency, electromechanical acoustic transducer system with a piezoelectric transducer having variations in its mechanical resonant frequency over an estimated maximum resonant frequency variance range, and a high frequency electrical transducer driving circuit for driving said electromechanical transducer, the improvement wherein: said high frequency electrical transducer driving circuit provides an automatically variable frequency electrical drive of said piezoelectric transducer which includes; a wide band sweep generator for initially sweeping said variable frequency electrical drive over a wide frequency range encompassing said range of variable resonant frequencies of said piezoelectric transducer, a resonant frequency detector for detecting when said frequency being swept by said sweep generator passes said resonant frequency of said piezoelectric transducer, a switching circuit actuated by said resonant frequency detector; and a control loop circuit connected by said switching circuit to control said variable frequency electrical drive to automatically track said variable resonant frequency of said piezoelectric transducer; and/or wherein said piezoelectric transducer has electrical impedance changes corresponding to change in its resonant frequency, and wherein said resonant frequency detector and said control loop circuit are both responsive to said electrical impedance changes in said piezoelectric transducer; and/or wherein said piezoelectric transducer is engaging a printer photoreceptor to provide an acoustic transfer assist system; and/or wherein said control loop circuit is a phase-lock loop circuit; and/or wherein said wide band sweep generator has a sweep range over several kilohertz; and/or wherein said piezoelectric transducer is a plural element transducer with small variations in the resonant frequencies of said plural elements, further including a chirp oscillator additionally varying said variable frequency over a much smaller frequency range than said wide band sweep generator or said control loop circuit when said switching circuit has connected said control loop circuit, so as to compensate for said small variations in said resonant frequencies of said plural elements of said piezoelectric transducer; and/or in a method of electrically driving an electromechanical transducer having a mechanical resonance varying over a substantial frequency range with an electrical power driver circuit, the improvement comprising: providing said electrical power driver circuit with a variable frequency electrical power output, automatically slowly initially sweeping said variable frequency electrical power output over a wide frequency range encompassing said substantial frequency range of said mechanical resonance of said electromechanical transducer, detecting from an electrical impedance change of said electromechanical transducer the approximate current resonant frequency of said electromechanical transducer, in response to detecting said approximate resonant mechanical frequency of said electromechanical transducer, disabling said automatically slowly initially sweeping of said variable frequency electrical power output over a wide frequency range and automatically phase lock loop controlling said variable frequency electrical power output of said electrical power driver circuit to variably drive said electrical power output of said electrical power driver circuit at said varying resonant frequency of said electromechanical transducer; and/or wherein said electromechanical transducer is engaging a printer photoreceptor to vibrate said photoreceptor; and/or wherein a small frequency range rapid dithering of said electrical power driver circuit frequency is provided above and below said resonant frequency of said electromechanical transducer.

As to specific components of the subject apparatus or methods, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for teachings of additional or alternative details, features, and/or technical background. What is well known to those skilled in the art need not be described herein.

The term "printer" as used herein broadly encompasses copiers, printers multifunction machines and other reproduction apparatus.

Various of the above-mentioned and further features and advantages will be apparent to those skilled in the art from the specific apparatus and its operation or methods described in the example below, and the claims. Thus, the present invention will be better understood from this description of this specific embodiment, including the drawing figures wherein:

Figure 1:
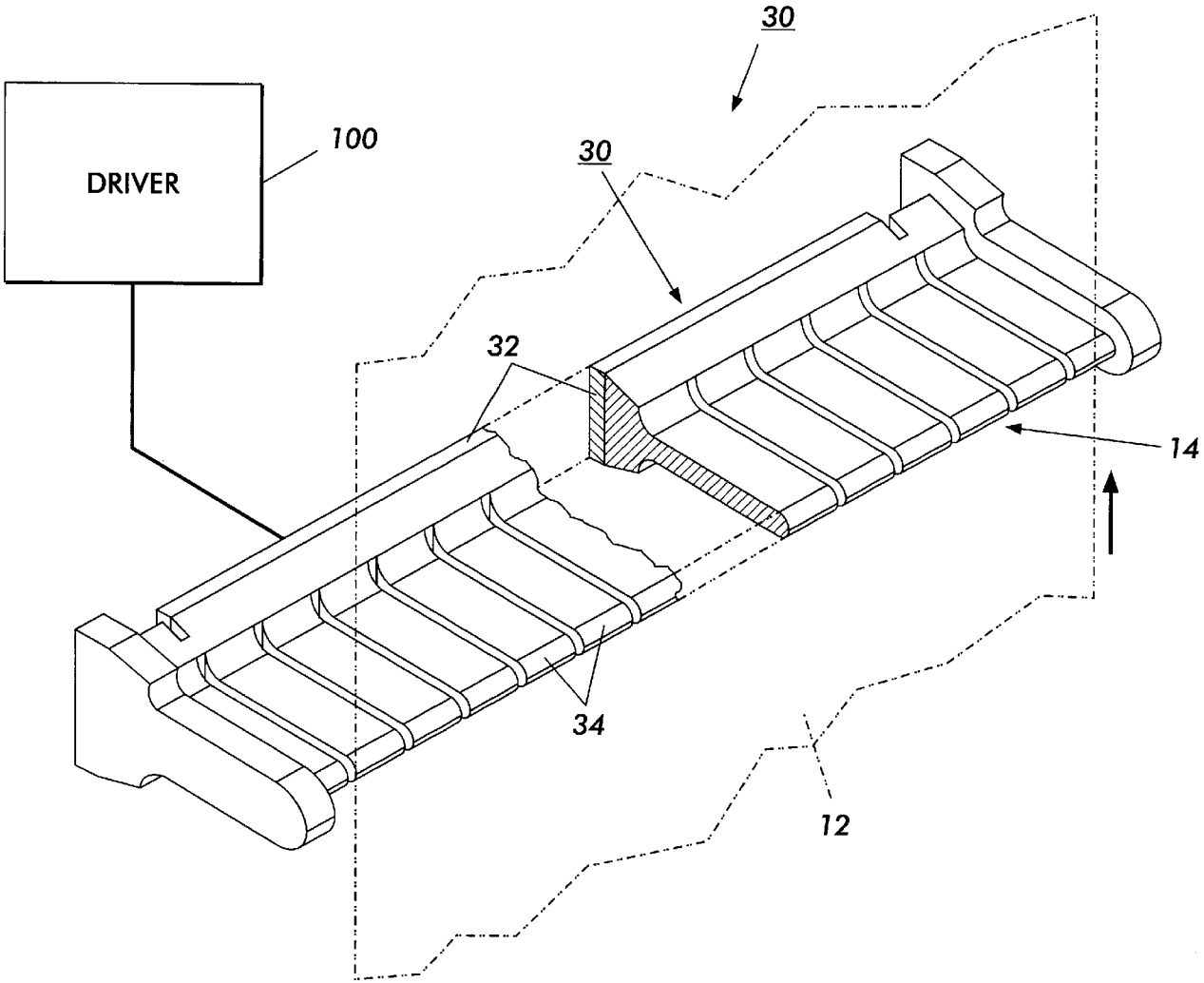
FIG. 1 is a perspective, partially broken away, view of a prior art segmented horn ATA transducer from an above-cited patent thereon, but being driven by a controlled transducer driver circuit in accordance with the present invention.
Figure 2:
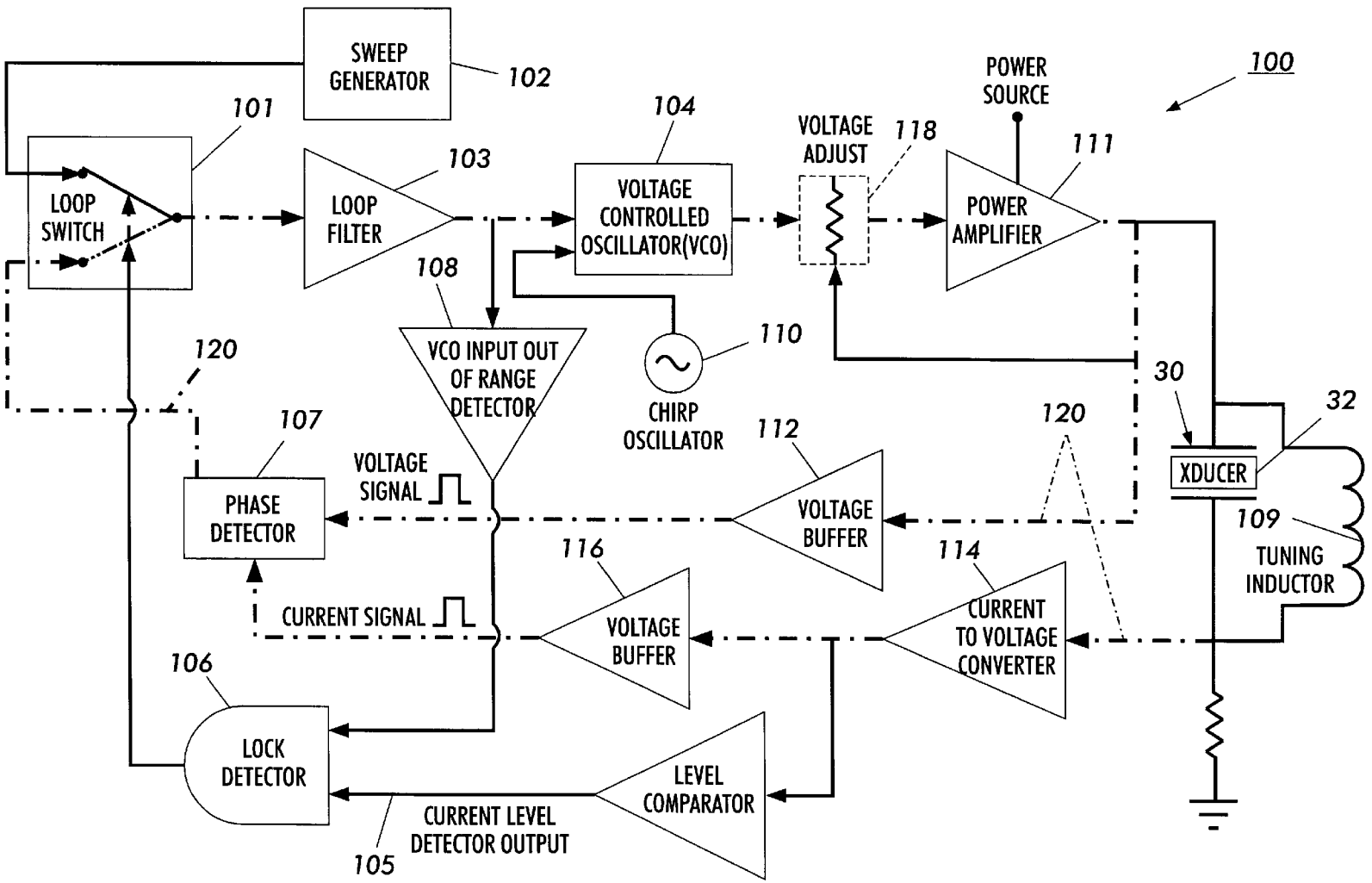
FIG. 2 is a detailed block diagram of one example of a controlled ATA transducer driver circuit of FIG. 1.
Figure 3:
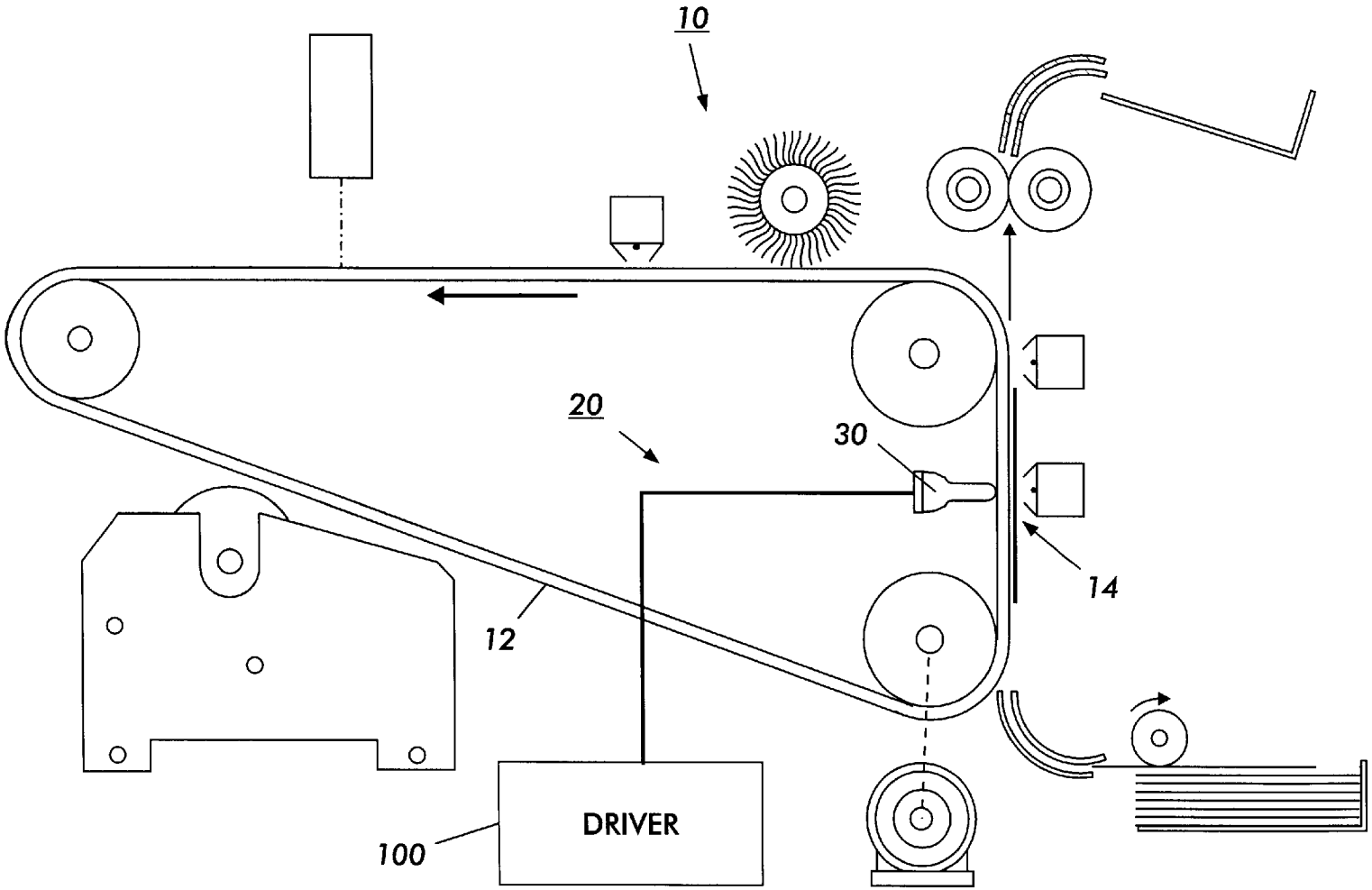
FIG. 3 is a simplified schematic view from an above-cited patent of an otherwise conventional xerographic printer illustrating the transducer and its driver circuit of FIG. 1 operating as an ATA.

Describing now in further detail the exemplary embodiment with reference to the Figures, there is shown in FIG. 3 a reproduction machine 10. It is disclosed by way of one example of an application of an exemplary ATA system 20 with a horn-shaped transducer 30 with segments 34 (as shown in FIG. 1), shown in FIG. 3 engaging the back of a photoreceptor 12 at a transfer station 14. The piezoelectric elements 32 of the transducer 30 are being driven by one example of the subject ATA driver circuit 100, as shown in the block diagram of FIG. 2. Since ATA systems in general, and this exemplary transducer 30 in particular, are described in detail in the above-cited patents, and well known in the art, they need not be re-described here.

As noted above, the resonance frequency of the transducer 30 can vary considerably due to various factors and conditions, yet for maximum efficiency it is desirable to drive the transducer 30 at its resonant frequency or frequencies.

The circuit 100 of FIG. 2 will be further described in the following functional description. The dot-dash circuit lines thereof illustrate a phase lock loop 120 thereof. At start up, before operation of the phase lock loop 120, a two input positions loop switch 101 initially connects a wide range sweep generator 102 through the loop filter 103 to the voltage controlled oscillator (VCO) 104. Thereby the VCO 104 (which controls the output frequency of circuit 100 applied to the transducer 30 via power amplifier 111) is swept over a wide sweep range by the wide range sweep generator 102. This sweep is at a slow rate, to find the resonance frequency of the transducer 30. For example, the approximate anticipated resonant frequency of the transducer 30 is swept once per second over an output frequency range of several KHz. At the resonance frequency of the transducer 30 the transducer has its minimum impedance. This is detected and signaled at the current level detector output 105 of a pre-set level comparator connected to the current to voltage converter 114, to change the state of one of the two parallel inputs to the lock detector 106, and thus change the state of the output of the lock detector 106. The lock detector 106 output switches the loop switch 101 from its previous sweep generator 102 input to the input from the phase detector 107, to thereby begin output control by the phase lock loop 120 instead of the sweep generator 102.

From then on, the phase detector 107 combines both the current and voltage input pulse signals to provide a control signal. This control signal is applied through loop filter 103 to the VCO 104 input so that the VCO output frequency is held to the point at which the voltage and the current through the transducer 30 are in phase. The loop filter 103 converts the phase detector output to a D.C. level for the VCO 104 input, and the VCO 104 output provides the driver frequency for the power amplifier 111 which drives the transducer 30 at that frequency.

To further explain the above, the inductor 109 in parallel with the transducer 30 is selected in value to cancel the housing capacitance of the transducer 30 at the mechanical resonant frequency. Hence, the transducer 30 with its inductor 109 looks like a series RLC electrical network to the output of the circuit 100, and the circuit 100 tracks the electrical resonance of that network. In other words, this RLC network is an electrical transformation of the transducer 30 mechanical system. The phase detector 107 continuously measures the phase between the transducer 30 applied voltage and current. Since that phase difference is approximately zero at transducer resonance, the output of the phase detector 107 provides a signal indicative of drifting or other changes in resonance. Therefore, this power supply circuit 100 for the transducer 30 automatically tracks changes in the mechanical resonance of the transducer 30 to automatically change the applied frequency with the phase lock loop 120.

Also optionally provided is a VCO 104 input "out of range" detector 108, which provides a second "yes or no" input to the lock detector 106, to prevent a control loop latch-up condition. A latch-up condition can occur when a large load change on the transducer 30 exceeds the frequency acquisition bandwidth of the phase lock control loop 120 during high drive levels. The phase lock control loop 120 may be unable to recover under those conditions when the drive level is high enough that the current level detector output 105 fails to deactivate the lock detector 106 output. This pulls the loop switch 101 back from phase lock loop control into the initializing position connecting the sweep generator 102.

As discussed in the above-cited U.S. Pat. No. 5,005,054, since the different segments 34 of a segmented transducer such as the transducer 30 will not normally all be resonant at the same exact applied frequency, when a transducer is so segmented it is desirable to slightly vary the applied frequency rapidly to insure excitation of all of the off-resonant segments. This ATA power supply circuit 100 accomplishes this by a dithering or small range frequency modulating of the output. The chirp oscillator 110 can do this by driving the VCO 104 with an audio frequency triangle wave, for example, so as to sweep the output frequency by plus and minus approximately 600 Hz at about one to five kHz. The frequency of this modulating wave must be high enough to prevent strobing of the prints made from the photoreceptor 12. However, it must be low enough to provide sufficient dwell time on the individual bar or segment resonant frequencies that will impart sufficient energy to excite the segments 34 in order to meet or exceed the transducer gain requirements. Transducer gain is defined as velocity in mm/sec divided by applied voltage in volts peak to peak. (The segment vibrations take 4 milliseconds to dampen out.)

In summary, after startup, the VCO 104 is primarily driven by a DC signal from the phase locked loop 120 tracking the transducer 30 resonance. In addition, a small (e.g., 100 times smaller than this DC signal) AC signal from the chirp oscillator 110 is used to vary the frequency slightly on either side of the transducer resonance.

Two desirable side effects can result from this chirp oscillator 110 small frequency variation driving of off-resonant segments 34 of the transducer 30. The first is lower power consumption, since the power supply doesn't dwell on the resonant frequency, as in conventional designs. The second can be a lowering of photoreceptor 12 standing wave amplitudes in its active vibration zone.

The desired wide range of output voltage and the current sense of a high power transducer power supply makes desirable (but not required) a power amplifier 111 that utilizes switch mode (square wave) technology. However, switch mode technology conventionally runs at a constant frequency. Here it has been modified to function with a variable frequency controlled by the phase lock loop circuit 120. The power amplifier 111 may be controlled by an automatic voltage adjust circuit 118, if desired. A wide range of output voltage and current from the power amplifier 111 can be handled by the phase lock loop circuit 120 with modifications such as voltage clamps for the voltage buffer 112 and the current-to voltage converter 114 and its output voltage buffer 116.

In conclusion, the disclosed specially controlled transducer driver power source example provides a unique control and output power drive that enables an ATA or other such acoustic transducer device to be more successfully operated. Wide variations in the initial resonant frequency of the transducer are accommodated, and automatically detected. Variations in the mean velocity of the transducer by temperature and load changes during operation are reduced by tracking variations in the resonant frequency of the transducer using phase lock loop technology. Velocity non-uniformity due to segment-to-segment resonant frequency variations in a segmented transducer is compensated for by frequency modulation applied to the multi-segment transducer. Furthermore, wider latitude is provided for changes in the manufacture or assembly of the transducer that cause variations in the transducer load impedance.

While the embodiment disclosed herein is preferred, it will be appreciated from this teaching that various alternatives, modifications, variations or improvements therein may be made by those skilled in the art, which are intended to be encompassed by the following claims.

What is claimed is:

1. In a xerographic printing system with a photoreceptor which is bearing toner imaging material and an acoustic transducer system for appropriately acoustically vibrating said photoreceptor to assist in the removal of said toner imaging material from said photoreceptor, wherein said acoustic transducer system has an electromechanical transducer with a variable resonant frequency variable within a range of variable resonant frequencies, and wherein said acoustic transducer system has an electrical power driver circuit for driving said electromechanical transducer for said appropriately acoustically vibrating of said photoreceptor to assist in said removal of said toner imaging material from said photoreceptor, the improvement wherein:

said electrical power driver circuit provides an automatically variable frequency electrical drive of said electromechanical transducer which includes;

a wide band sweep generator for initially sweeping said variable frequency of said variable frequency electrical drive of said electrical power driver circuit over a wide frequency range encompassing said range of variable resonant frequencies of said electromechanical transducer, a resonant frequency detector for detecting when said frequency being swept by said sweep generator passes said resonant frequency of said electromechanical transducer, a switching circuit actuated by said resonant frequency detector;

and a control loop circuit connected by said switching circuit to control said variable frequency electrical drive of said electrical power driver circuit to automatically track said variable resonant frequency of said electromechanical transducer.

2. The xerographic printing system of claim 1, wherein said electromechanical transducer has electrical impedance changes corresponding to said variable resonant frequency of said electromechanical transducer, and wherein said resonant frequency detector and said control loop circuit are both responsive to said electrical impedance changes in said electromechanical transducer.

3. The xerographic printing system of claim 1, wherein said control loop circuit is a phase-lock loop circuit.

4. The xerographic printing system of claim 1 wherein said wide frequency range of said wide band sweep generator is several kilohertz.

5. The xerographic printing system of claim 1, wherein said electromechanical transducer is a plural element transducer with small variations in the resonant frequencies of said plural elements, and wherein said electrical power driver circuit further includes a chirp oscillator additionally varying said variable frequency over a much smaller frequency range than said wide frequency range of said wide band sweep generator or said control loop circuit when said switching circuit has connected said control loop circuit, so as to compensate for said small variations in said resonant frequencies of said plural elements of said electromechanical transducer.

6. The xerographic printing system of claim 1, wherein said sweep generator has a plural kilohertz sweep range and an approximately one second sweep cycle.

7. The xerographic printing system of claim 5, wherein said chirp oscillator has a sweep range of approximately zero to +600 hertz and an approximately 1 to 5 kilohertz sweep frequency.

8. A high-power, high frequency, electromechanical acoustic transducer system with a piezoelectric transducer having variations in its mechanical resonant frequency over an estimated maximum resonant frequency variance range, and a high frequency electrical transducer driving circuit for driving said electromechanical transducer, the improvement wherein:

said high frequency electrical transducer driving circuit provides an automatically variable frequency electrical drive of said piezoelectric transducer which includes;

a wide band sweep generator for initially sweeping said variable frequency electrical drive over a wide frequency range encompassing said range of variable resonant frequencies of said piezoelectric transducer, a resonant frequency detector for detecting when said frequency being swept by said sweep generator passes said resonant frequency of said piezoelectric transducer, a switching circuit actuated by said resonant frequency detector;

and a control loop circuit connected by said switching circuit to control said variable frequency electrical drive to automatically track said variable resonant frequency of said piezoelectric transducer.

9. The high-power, high frequency, electromechanical acoustic transducer system of claim 8, wherein said piezoelectric transducer has electrical impedance changes corresponding to change in its resonant frequency, and wherein said resonant frequency detector and said control loop circuit are both responsive to said electrical impedance changes in said piezoelectric transducer.

10. The high-power, high frequency, electromechanical acoustic transducer system of claim 8, wherein said piezoelectric transducer is engaging a printer photoreceptor to provide an acoustic transfer assist system.

11. The high-power, high frequency, electromechanical acoustic transducer system of claim 8, wherein said control loop circuit is a phase-lock loop circuit.

12. The high-power, high frequency, electromechanical acoustic transducer system of claim 8, wherein said wide band sweep generator has a sweep range over several kilohertz.

13. The high-power, high frequency, electromechanical acoustic transducer system of claim 8, wherein said piezoelectric transducer is a plural element transducer with small variations in the resonant frequencies of said plural elements, further including a chirp oscillator additionally varying said variable frequency over a much smaller frequency range than said wide band sweep generator or said control loop circuit when said switching circuit has connected said control loop circuit, so as to compensate for said small variations in said resonant frequencies of said plural elements of said piezoelectric transducer.

14. In a method of electrically driving an electromechanical transducer having a mechanical resonance varying over a substantial frequency range with an electrical power driver circuit, the improvement comprising:

providing said electrical power driver circuit with a variable frequency electrical power output, automatically slowly initially sweeping said variable frequency electrical power output over a wide frequency range encompassing said substantial frequency range of said mechanical resonance of said electromechanical transducer, detecting from an electrical impedance change of said electromechanical transducer the approximate current resonant frequency of said electromechanical transducer, in response to detecting said approximate resonant mechanical frequency of said electromechanical transducer, disabling said automatically slowly initially sweeping of said variable frequency electrical power output over a wide frequency range and automatically phase lock loop controlling said variable frequency electrical power output of said electrical power driver circuit to variably drive said electrical power output of said electrical power driver circuit at said varying resonant frequency of said electromechanical transducer.

15. The method of electrically driving an electromechanical transducer of claim 14, wherein said electromechanical transducer is engaging a printer photoreceptor to vibrate said photoreceptor.

16. The method of electrically driving an electromechanical transducer of claim 14, wherein a small frequency range rapid dithering of said electrical power driver circuit frequency is provided above and below said resonant frequency of said electromechanical transducer.

* * * * *